United States Patent [19]

Zuckler

[11] 4,223,192

[45] Sep. 16, 1980

[54] GAS BLAST CIRCUIT BREAKER

[75] Inventor: Karl Zuckler, Berlin, Fed. Rep. of Germany

[73] Assignee: Siemens Aktiengesellschaft, Munich, Fed. Rep. of Germany

[21] Appl. No.: 970,215

[22] Filed: Dec. 18, 1978

[30] Foreign Application Priority Data

Dec. 30, 1977 [DE] Fed. Rep. of Germany ..... 2759268

[51] Int. Cl.[2] ..... H01H 33/88

[52] U.S. Cl. ..... 200/148 R; 200/148 A

[58] Field of Search ..... 200/148 R, 148 A, 148 B, 200/148 C, 148 D, 148 E, 148 F, 148 G, 148 H, 148 J, 148 BV, 150 G

[56] References Cited

U.S. PATENT DOCUMENTS

| | | | |
|---|---|---|---|
| 3,855,437 | 12/1974 | Goedecke et al. | 200/148 R |
| 4,080,521 | 3/1978 | Goedecke et al. | 200/148 R |

*Primary Examiner*—J. V. Truhe
*Assistant Examiner*—Morris Ginsburg
*Attorney, Agent, or Firm*—Kenyon & Kenyon

[57] ABSTRACT

A blasting piston ("puffer") circuit breaker having two stationary nozzle-shaped contacts which are bridged in the "on" position by a hollow, cylindrical, movable contact and an annular body of insulating material for reducing the cross-section of the oncoming flow between the stationary contacts during the course of the switching-off motion. The annular body has an axial dimension smaller than the length of the gap between the stationary contacts and is placed approximately in the middle between the bottom of the cylinder and the free end of the movable contact.

4 Claims, 2 Drawing Figures

GAS BLAST CIRCUIT BREAKER

BACKGROUND OF THE INVENTION

This invention relates to a gas blast circuit breaker having two stationary nozzle-shaped contacts which are bridged in the "on" position by a hollow cylindrical movable contact and having a blasting device consisting of a piston and a movable cylinder. The movable cylinder is coupled to the movable contact and, in the course of switching off, runs off of one of the stationary contacts. An annular member of insulating material is provided which reduces the cross-section of the oncoming gas flow between the stationary contacts during the process of switching off.

A gas blast circuit breaker of this general type is described in German Auslegeschrift No. 24 38 017. There an annular member of insulating material in the form of a tube is perforated on its cylindrical surface and directly surrounds the arcing space during the quenching phase. The tube is coupled to the movable part of the blasting ("puffer") device, the blasting cylinder, at the bottom, enclosing the stationary contact, and to the free end of the bridging contact. As quenching of the arc drawn between the two stationary contacts must have been completed before the annular member has left the gap between the two stationary contacts, the open gap becomes bridged by parts of insulating material. This reduces the dielectric strength of the quenched contact system.

If, on the other hand, the annular member of insulating material which reduces the cross section of the oncoming flow between the stationary contacts in the course of the switching off is dispensed with, the quantity of gas flowing through the gap which, from a gas flow point of view, is designed as an annular gap, becomes disproportionally large. Correspondingly large blasting devices and outflow cross-sections must then be used.

In gas blast breakers which have only a small compression volume for the quenching gas, another problem arises. For a given current, an arc column develops between the arc electrodes, which, as a first approximation, has a thickness proportional to the current. The inside diameter of the hollow nozzle-shaped contacts into which the arc must enter must be designed for this purpose. The diameter of the nozzle-shaped contacts is thereby largely established by the need for a reliable quenching of the arc.

Independently thereof, however, the gap must have enough dielectric strength between the opened contacts after the arc is quenched to make refiring of the arc impossible. This requires so large a distance between the stationary nozzle-shaped contacts or so great a length of gap that, at higher voltages, the radial gas flow velocity in the gap becomes substantially lower than in the nozzles of the stationary contacts. This can lead to undesirable outward travel of the arc. For this reason, a member of insulating material which reduces the cross-section of the oncoming flow between the stationary contacts is advantageous in puffer breakers for higher voltages and large currents.

SUMMARY OF THE INVENTION

It is an object of this invention to provide a gas blast circuit breaker in which the presence of the annular member of insulating material does not lead to any reduction of the dielectric strength of the gap and, with respect to capacitive currents, contributes to an improvement of the switching behavior.

According to the invention, this problem is solved by making the member of insulating material shorter in axial dimension than the length of the gap between the stationary contacts and by placing it approximately in the middle, between the bottom of the cylinder and the free end of the movable contact. Through use of this structure, the gas throughput in the region of the oncoming flow in the gap is controlled, with the radial flow velocity of the quenching gas in the gap and the axial flow velocity in the nozzle-shaped contacts being approximately equal, taking the change in density into consideration. The gas throughput is thereby optimized in an advantageous manner.

In a further feature of the invention, the annular member can consist, at least in part, of a material which gives off additional quenching gas when subjected to an arc. Also, the axial dimension of the annular member is preferably about one-half of the gap spacing. In a preferred embodiment of the invention, the annular member is supported by a screen-like wall which serves as an intermediate bottom and extends transversely to the axis of the cylinder. In it, the total area of the passage openings must be at least as large as the outflow cross-section through the nozzles.

DETAILED DESCRIPTION OF THE INVENTION

Figure 1:
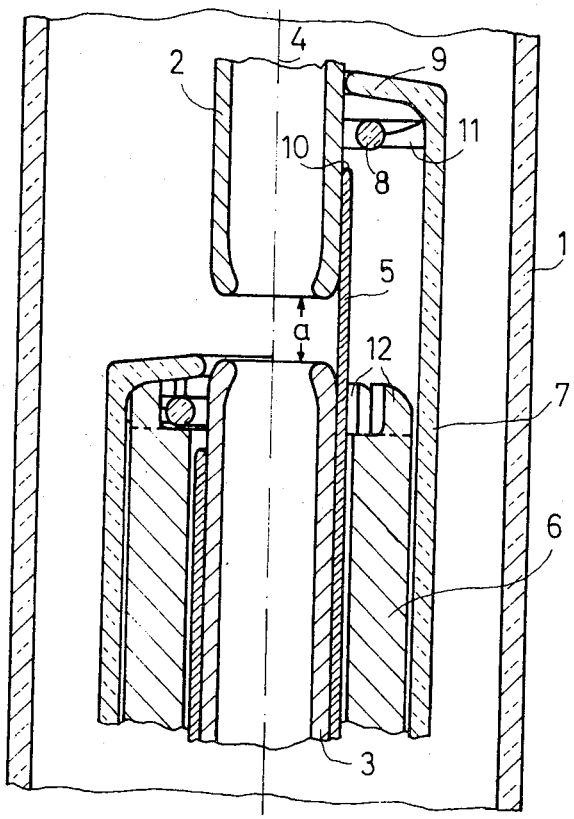
FIG. 1 is a side view, in cross-section, of a portion of a gas blast circuit breaker embodying the teachings of the invention; the right side shows the breaker in the "on" position and the left side, the "off" position.

The drawing of FIG. 1 shows only the parts of the gas blast circuit breaker which are necessary for the understanding of the invention; the drive and the insulators for supporting the switching chamber are omitted. Contained within a switching chamber 1, which is made of insulating material, is gaseous sulfur hexafluoride at a pressure of, for example, 6 bar which serves as the quenching and insulating medium of the breaker. The switching chamber 1 encloses two stationary nozzle-shaped contacts 2 and 3 which in the "on" position (shown to the right of center line 4) are bridged by a movable hollow, cylindrical contact 5. In the "off" position (shown to the left of center line 4), the gap between the contacts 2 and 3 is free. Included in the structure of the gas blast circuit breaker is a blasting device having a stationary piston 6 and a movable cylinder 7. The bottom 9 of movable cylinder 7 extends inward towards stationary contact 2 to form, in conjunction with piston 6 and movable contact 5, a space in which the quenching gas is first compressed in the course of the switching-off motion, and then discharged into the interior of contacts 2 and 3 via the annular gap between the contacts when movable contact 5 clears the region of the switching gap. From the instant when the movable contact 5 is separated from the stationary contact 2, the switching gap and, thereby, the cross-section effective for the passage of gas, is increased until the downward travel of annular member 8 reduces the effective cross-section for gas flow between the stationary contacts 2 and 3. For this purpose, the annular member 8 has an axial dimension which is shorter than the length a of the gap between the contacts 2 and 3. It is placed in the aproximate middle of the distance between the bottom 9 of cylinder 7 and the free end 10 of movable contact 5. Preferably, the axial dimension of annular member 8 is about one-half of the gap a. It is made of insulating material and is supported by intermediate wall 11, having radial members extending transversely of the axis 4 of cylinder 7. The wall 11 is thus preferably a screen-like with openings adapted for through passage of projecting piston parts 12. Piston parts 12 thus fill space otherwise available for accumulating gas outside of space subjected to the compression process.

Figure 2:
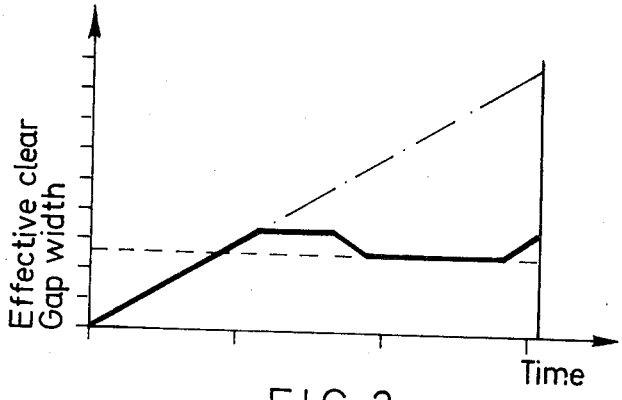
FIG. 2 is a chart of effective clear gap width against opening time of a breaker employing the teachings of the invention.

The chart of FIG. 2 shows the effective clear gap width in the region of the switching gap plotted against time, e.g., as a function of the distance travelled by the movable contact 5 during the switching off motion. It is thus possible, for the same current and, accordingly, for an arc column of the same thickness, to increase the length of the switching gap during the switching-off process; i.e., to provide an interrupter unit for a higher rated voltage without any danger of reduction of the arc blast as a result of reduced radial flow velocity, and consequent outward travel of the arc.

What is claimed is:

1. A gas circuit breaker comprising two stationary nozzle-shaped contacts which are spaced apart to leave a gap, a hollow cylindrical movable contact for bridging the gap between the stationary contacts when in the "on" position, a blasting device comprising a piston and a movable cylinder, the movable cylinder having a bottom surrounding a first of said stationary contacts and being coupled to the hollow movable contact for motion off of the first contact and past the gap during the switching-off process, and an annular member of insulating material having a length which is shorter in the axial direction than the length of the gap for reducing the cross-section of the oncoming flow between the stationary contacts in the course of the switching-off process, the annular member being carried by the movable cylinder approximately centered between the bottom of the movable cylinder and the free end of the movable contact,

2. The gas blast circuit breaker of claim 1, in which the annular member of insulating material consists, at least in part, of a material which gives off additional quenching gas when exposed to an arc.

3. A gas blast circuit breaker in accordance with claim 1, in which the axial dimension of the annular member of insulating material is approximately one-half that of the gap.

4. A gas blast circuit breaker in accordance with one of the claims 1, 2 or 3, in which the annular member of insulating material is supported by a screen-like wall of radial members serving as an intermediate bottom extending transversely to the axis of the piston cylinder.

* * * * *